US005975310A

United States Patent [19]

Darling et al.

[11] Patent Number: 5,975,310

[45] Date of Patent: Nov. 2, 1999

[54] METHOD AND APPARATUS FOR BALL SEPARATION

[76] Inventors: Richard S. Darling, 3832, W. 32nd St. Erie, Pa. 16506; Arturo Tomás Lema Pye, Los Jazmines 763 Ñuñoa, Santiago, Chile; Richard A. Merwin, 4110 Millfair Rd.; Marshall A. Carner, 3832 W. 32nd St., both of Erie, Pa. 16506; Carlos Stipicic, Los Pamperos 424, Centro de Casillas 70, Santiago; Lumie Zuniga, Av. Angamos 721, Antofagasta, both of Chile

[21] Appl. No.: 08/941,625

[22] Filed: Sep. 30, 1997

Related U.S. Application Data

[60] Provisional application No. 60/035,953, Jan. 17, 1997.

[51] Int. Cl.[6] ..... B07C 5/344

[52] U.S. Cl. ..... 209/636; 209/221

[58] Field of Search ..... 209/38, 215, 221, 209/228, 288, 683, 219, 223.1

[56] References Cited

U.S. PATENT DOCUMENTS

| | | | |
|---|---|---|---|
| 788,675 | 5/1905 | Rissmuller . | |
| 953,092 | 3/1910 | Kennedy . | |
| 1,313,734 | 8/1919 | Randall . | |
| 2,269,912 | 1/1942 | Ladoo et al. | 83/94 |
| 2,428,228 | 9/1947 | Keck | 209/2 |
| 2,968,524 | 1/1961 | Seeton | 23/14.5 |
| 3,086,718 | 4/1963 | Lukas, Jr. | 241/24 |
| 3,291,398 | 12/1966 | Weston et al. | 241/24 |
| 3,489,280 | 1/1970 | Israelson et al. | 209/223 |
| 3,684,090 | 8/1972 | Kilbride | 209/214 |
| 3,901,795 | 8/1975 | Smith et al. | 209/39 |
| 4,124,497 | 11/1978 | Hulegard | 209/3 |
| 4,230,560 | 10/1980 | Nakajima | 209/221 X |
| 4,318,804 | 3/1982 | Nakajima | 209/221 |
| 4,441,659 | 4/1984 | Marklund | 241/70 |
| 4,665,591 | 5/1987 | Imai et al. | 209/38 |
| 4,781,821 | 11/1988 | Salmi | 209/223.1 X |
| 5,091,077 | 2/1992 | Williams | 209/12 |
| 5,490,928 | 2/1996 | Tanii | 210/380.3 |
| 5,551,573 | 9/1996 | Davis | 209/38 |

*Primary Examiner*—William E. Terrell
*Assistant Examiner*—Gene O. Crawford
*Attorney, Agent, or Firm*—Lovercheck and Lovercheck

[57] ABSTRACT

The arcuate magnet is made up of a series of magnets that produce a radial shape magnetic field. The arcuate magnet is supported adjacent the outer periphery of the cylindrical blind trommel. The blind trommel is rotated. Steel balls and magnetic material are held to the inner periphery of the blind trommel and carried with it to the end of the arcuate magnet. The arcuate magnet may be made up of either electromagnets or permanent magnets. Another embodiment has one or more magnets attached to spaced positions around the outer periphery of the trommel. Permanent or electromagnets may be employed. Electromagnets are connected to slip rings that energize the magnets from about the 6 o'clock position and de-energize the magnets at about the 11 o'clock position. The permanent magnets are moved away from the blind trommel at about the 11:00 o'clock position. The magnetic material is released from the blind trommel at about the 11:00 o'clock position and collected in a tray inside the blind trommel. One magnet or a plurality of magnets can be used.

21 Claims, 10 Drawing Sheets

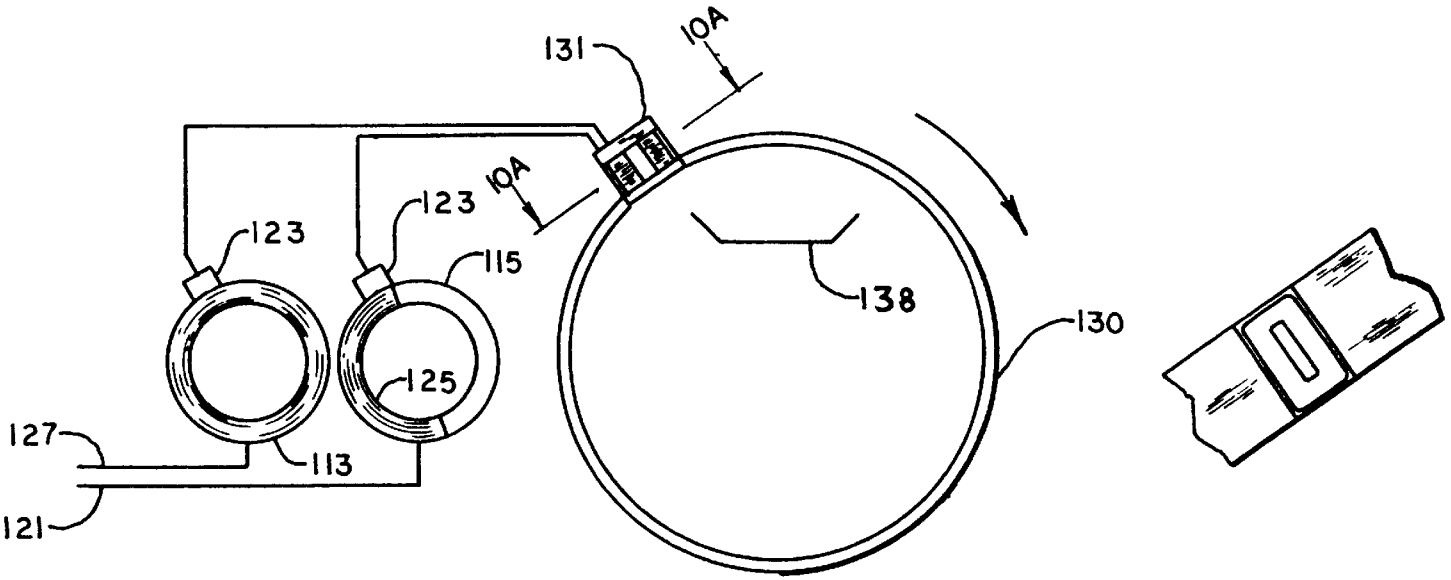
FIG. 10
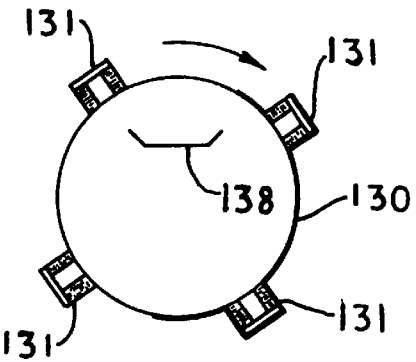
FIG. 10A
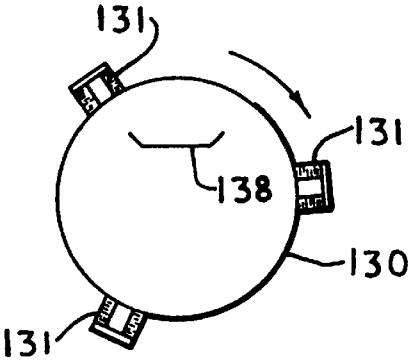
FIG. 11B
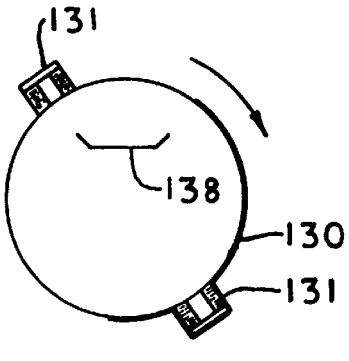
FIG. 11A
FIG. 11C

METHOD AND APPARATUS FOR BALL SEPARATION

This application claims the benefit of U.S. Provisional Application Ser. No. 60/035,953 filed Jan. 17, 1997.

BACKGROUND OF THE INVENTION

The present invention relates to a method of separating steel balls and other ferromagnetic material from non-ferromagnetic ore as the materials move out of a ball mill or a similar apparatus. The invention has utility in magnetic separators in general.

The problem that this invention addresses is that the balls used in a ball mill or a similar apparatus are frequently carried out of the mill with the ore. This happens more frequently as the balls wear down to a size approaching the target ore size. These balls, which are primarily steel, can damage downstream equipment such as pumps as they pass through the system. To prevent this damage, it is desirable to remove the balls from the ore before it leaves the mill.

SUMMARY OF THE INVENTION

A method and an apparatus is disclosed for separating the magnetic portion from a mixture of ferromagnetic balls and other ferromagnetic material and non-ferromagnetic ores. The proposed device accomplishes this separation by means of a partial arc of permanent magnets partially surrounding a blind trommel. The mill discharge section includes a trommel having holes therethrough of a size to allow pieces of a desired size to pass through. The magnet causes the steel balls to be held against the inner surface of the blind trommel on the rising side. The balls are carried to an area near the top of the blind trommel, where the magnetic arc terminates. As the balls emerge from the magnetic influence they drop from the blind trommel inner surface and are collected in a hopper or tray. The tray has a chute at a side thereof which directs the balls to a suitable collection point.

The method and apparatus described herein can be used in general magnetic separating environments. A magnet is used having a concave surface that has an upwardly facing part, an inwardly facing part and a downwardly facing part. A non-magnetic rotating conveyor member is adjacent the magnet and running in close proximaty to the parts of the magnetic surface. Magnetic and non-magnetic material to be separated are placed on the upwardly facing part of the conveyor. The magnetic portion is held to the conveyor by the magnetic field while it is carried from the upwardly facing part up the inwardly facing part to the downwardly facing part. When the magnetic portion passes beyond the influence of the magnetic field it falls into a tray. A chute can be connected to the tray to carry the balls and magnetic material to a collecting area.

In accordance with the example of the method disclosed in the present invention, a separate and grade mill is provided in which the ore is broken down to a target ore size, and the target size ore is separated in a rotating trommel placed downstream from the mill to grade the ore. A blind trommel is provided adjacent the trommel and may be placed either upstream or downstream therefrom. Thus the grading may be done before or after the magnetic portion is removed. The blind trommel is a rotating cylinder having the same diameter as the trommel, but has no outlets for grading the ore. Surrounding approximately one-half of the blind trommel is situated an arc of permanent magnets or electromagnets partially surrounding the blind trommel. The magnet causes the steel balls and other ferromagnetic material to be pinned to the inner surface of the blind trommel on the rising side. The magnetic portion including the steel balls are carried to an area near the top of the blind trommel where the magnetic arc terminates. At this point, the magnetic portion including the balls are dropped from the inner periphery of the blind trommel and are collected in a hopper and are directed down a chute to a suitable collection point. From the collection point the balls can be returned upstream and reused. The remaining portion can be disposed of as appropriate.

One or more lifters may be provided in the blind trommel. The lifter may consist of one or more raised portions on the inner surface to assist in the lifting of the magnetic material to the top of the blind trommel. Inside the blind trommel below the top, is situated a non-magnetic tray or hopper. The chute may be made of stainless steel to direct the balls and magnetic portion of the ore to a collection point.

In accordance with the apparatus of the present invention, a structure is provided to separate ferromagnetic pieces such as steel balls from a stream of non-ferromagnetic ore as it leaves, for example, a ball mill, or similar structure. The flow may proceed through a trommel where sized pieces are separated.

Upstream or downstream from the trommel section, a blind trommel section is provided that provides a rotating surface for collecting and lifting the balls. A lifter comprising a raised section attached to the inner periphery of the blind trommel and projecting inwardly therefrom. The upstream side of the lifter may be essentially normal to the blind trommel (i.e. perpendicular thereto). The downstream side of the lifter may be joined to the blind trommel at a forty-five degree or smaller angle.

The arc shaped magnet for the purpose of lifting and separating steel balls extends approximately half way around the blind trommel. It is supported adjacent the trommel which rotates therein. The arc shaped magnet member may be made of permanent magnets or electromagnets.

In another embodiment, two symmetrical arc shaped magnet members may be provided, one on each side of the blind trommel whereby when the direction of rotation of the mill is reversed, the balls will be carried up the other side and dropped into the tray.

Another alternative embodiment provides a device that will work regardless of which direction the trommel is rotated and incorporates a single arc shaped magnet that is supported and moveable on a fixed circular track where the position of the magnets can be optimized and the position of the magnet can be moved to the opposite side periodically when the direction of the rotation of the mill is reversed.

In another embodiment of the invention electromagnets can be used to replace the permanent magnets described herein.

A blind trommel section may have attached to the outside surface thereof an electromagnet, arranged so that when the electromagnet is energized, ferrous material inside the trommel section will be attracted to the inner surface of the trommel in the vicinity of the electromagnet. As the trommel is rotated, the electromagnet is energized from approximately the 6 o'clock magnet position through the 11 o'clock magnet position, at which point it is de-energized, causing the lifted ferrous material to fall into a collection hopper and chute. By attaching the magnet to the blind trommel outer surface, at least two advantages are realized as compared to the stationary arc of magnets. First, fewer magnets may be used since a continuous magnetic field is not required from the 6 o'clock to the 11 o'clock trommel positions; and second, because the magnetic field travels with the blind trommel surface the need for an internal scraper bar, or lifter, to keep the ferrous material moving is minimized or eliminated.

One or more electromagnets may be disposed around the periphery of the blind trommel at multiple stations and may be energized and de-energized sequentially as the blind trommel rotates. This will increase the ferrous collection capacity of the system.

A similar device can be with a permanent magnet arranged so that it can be rotated away from the outer surface of the blind trommel by a suitable actuator, mechanical linkage, or balance arrangement when the magnet reaches approximately the 11 o'clock position where the magnetic portion is to be released into the tray. The linkage or balance arrangement causes the magnet to remain in the "disengaged" position until the tray has been passed, at which point the magnet swings back into engagement with the trommel blind surface. By using a permanent magnet rather than an electromagnet, the initial and operating costs are potentially reduced.

A similar device can be used with a number of permanent magnets disposed around the outer periphery of the trommel at multiple stations. Each magnet will be moved away from the blind trommel in turn to release he magnetic portion into the tray. This will increase the ferrous collection capacity of the system.

An electromagnet may be attached to the inside surface of the blind trommel, protected by a suitable housing. An advantage of this arrangement is that the magnet housing itself will serve as a scraper bar or lifter to eliminate any possibility of loss of ferrous material on the rising side of the trommel. Also, by virtue of its location on the inner surface of the trommel, the magnet will attract and hold the ferrous material more efficiently.

A similar device using multiple electromagnets disposed around the inner surface of the trommel may be used.

A single arc shaped magnet may be pivoted around a vertical axis and used as a lifting magnet on either side of the blind trommel depending on the direction of rotation of the mill and its periodic reversals.

A structure that incorporates a single arc shaped magnet which by suitable electrical or mechanical linkage, changes magnet position automatically when the mill changes direction of rotation.

The magnet may be mounted on a rail to support the magnet. The magnet may be adjusted by mounting it along the rail to optimize the position of the magnet within a predetermined range.

Applicant is aware of the following U.S. Pat. Nos. 788,675; 953,092; 1,313,734; 2,269,912; 2,428,228; 2,968,524; 3,086,718; 3,291,398; 3,489,280; 3,684,090; 3,901,795; 4,124,497; 4,441,659; 4,666,591; 5,091,077; and, 5,490,928.

It is an object of the present invention to provide an improved apparatus and method for separating a magnetic portion from a stream comprising a mixture of magnetic and non-magnetic materials.

It is an object of the present invention to provide an improved apparatus and method for separating a magnetic portion from a stream of material passing through an enclosed rotating structure. It is another object of the present invention to provide a magnetic ball separator that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

Features of the invention include: an arc shaped magnet for lifting and separating steel balls; a central discharge chute that collects and carries the balls away; a blind trommel section that provides a lifting surface for collecting and lifting balls; the specific magnetic circuit for enhanced holding power and reduced agitation of the balls; a blind trommel with two symmetrical arc shaped magnets to provide for periodic reversals in directions and rotations of the mill; a blind trommel a singular arc shaped magnet that moves on a fixed circular track to provide for periodic adjustments in the direction and rotation of the mill for optimizing the position of the magnets is within the scope of the invention; a blind trommel with a single arc shaped magnet attached to its frame work that moves along an arc to provide for periodic reversals in the direction of rotation of the mill and for optimizing the position of the magnets is contemplated; a blind trommel having a single arc shaped magnet that pivots around a vertical access to provide for periodic reversals in the direction of rotation of the mill; a blind trommel that incorporates a single arc shaped magnet that includes an electrical mechanical linkage so that the magnet position changes automatically when the mill changes direction of rotation; and, permanent magnets are replaced by electromagnets by suitable circuit technology.

BRIEF DESCRIPTION OF THE DRAWING(S)

FIG. 10 is a continuous end of a blind trommel and magnet according to the invention, equipped with an electromagnet and slip rings substituted for a permanent magnet.

FIG. 10A is a cross sectional view of an electromagnet taken on line 10A—10A of FIG. 10.

FIG. 11A is a blind trommel equipped with two electromagnets.

FIG. 11B shows a blind trommel equipped with three electromagnets.

FIG. 11C shows a blind trommel equipped with four electromagnets.

DESCRIPTION OF THE PREFERRED EMBODIMENT(S)

Figure 1:
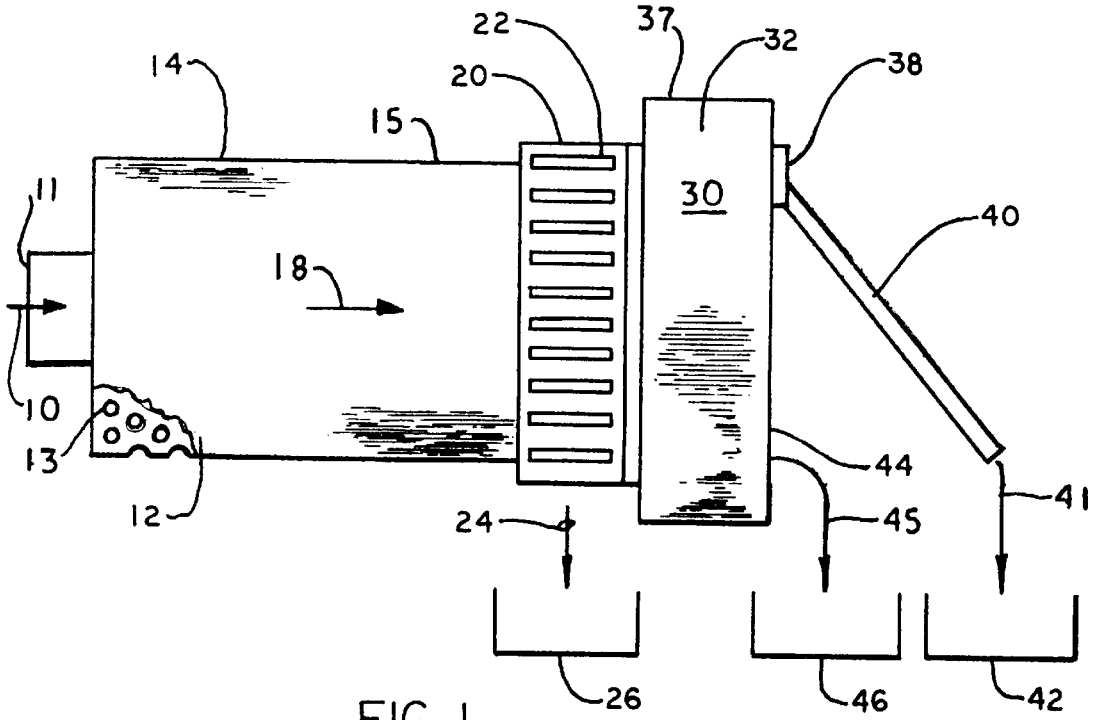
FIG. 1 is a side view of a ball mill, trommel and blind trommel with arc shaped magnet according to the invention.
Figure 2:
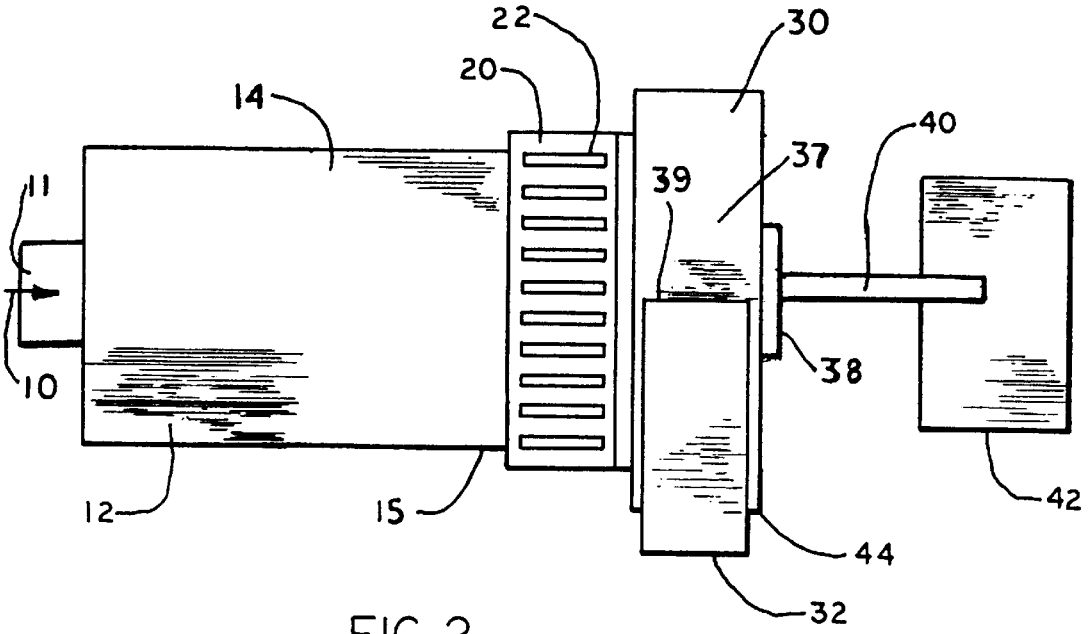
FIG. 2 is a top view of a ball mill, trommel and blind trommel with arc shaped magnet and tray according to the invention.

Now with more particular reference to the drawings, FIGS. 1 and 2 show ball mill 14 generally comprising a large generally cylindrical body disposed in a horizontal position and rotatable alternately in a clockwise and a counter clockwise direction. Ore to be reduced is inserted at position 10 through inlet 11 in input end 12 of ball mill 14. Ball mill 14 contains hard balls 13 usually made of steel, which are tumbled with the ore to break the ore down to desired sizes. At output end 15 of ball mill 14 trommel 20 is provided which is also cylindrical and also rotated. Trommel 20 has predetermined sized holes 22 therethrough of a predetermined size to allow the ore of a particular size to be separated at position 24 by means of gravity into suitable collecting means 26 from which the sized ore is directed to further processing. The remaining ore portion plus any steel balls which have been passed out of ball mill 14 then continue in downstream direction 18 into blind trommel 30. Blind trommel 30 is of a size and shape similar to trommel 20, but is not provided with ore grading holes. Blind trommel 30 is a solid sided cylinder and rotates with trommel 20. Supported over a portion of blind trommel 30 immediately adjacent its outer surface is arc shaped magnet 32 which will extend from substantially the bottom of blind trommel 30 to a position adjacent top 37 thereof. The inner surface of blind trommel 30 may be provided with one or more magnetic lifters 34. Magnetic lifters 34 may be provided with first side 35 which is attached to blind trommel 30 generally perpendicular thereto. Second side 36 which is attached to blind trommel 30 at an angle of less than ninety degrees. As blind trommel 30 rotates, the magnetic portion of the contents will be held against the wall of blind trommel 30 by magnetic field 31 of arc shaped magnet 32. Magnetic lifter 34 will assist in raising the magnetic part of the ore portion through the arc upwardly to a point adjacent top 37 of blind trommel 30 where magnet 32 ends and the magnetic material that has been raised, passes out of the influence of magnet 32 and drops from blind trommel 30 inner surface into tray 38. Tray 38 is made of a size sufficient to catch magnetic material passing beyond end 39 of magnet 32 into tray 38. The material passes from tray 38 through chute 40 and is collected at position 41 in suitable collection means 42 from which balls 13 are returned to ball mill 14 for further use. The non-magnetic unsized remainder of the ore passes out of discharge end 44 of blind trommel 30 and is directed at position 45 to suitable collection means 46 and from there the ore is returned by suitable means to ball mill 14 for further processing.

Figure 4:
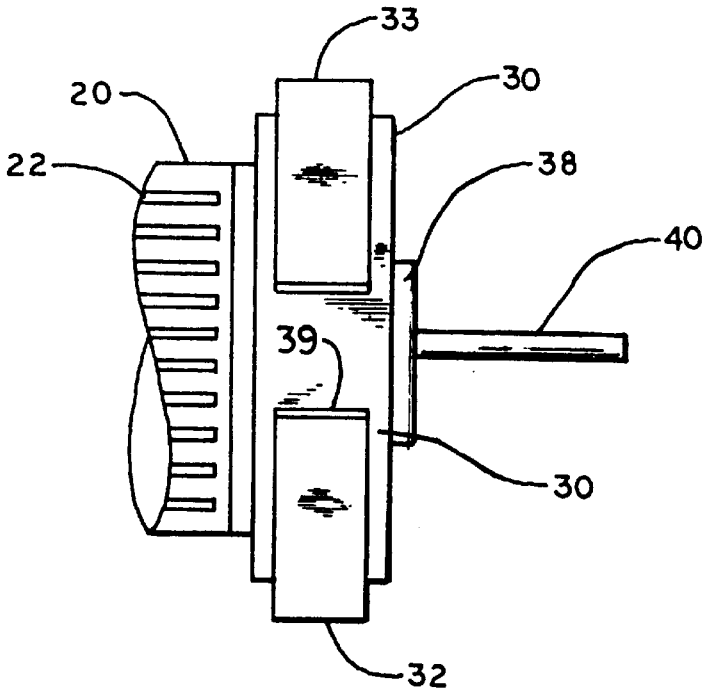
FIG. 4 is a top view of the blind trommel having two arc shaped magnets according to another embodiment of the invention.
Figure 5:
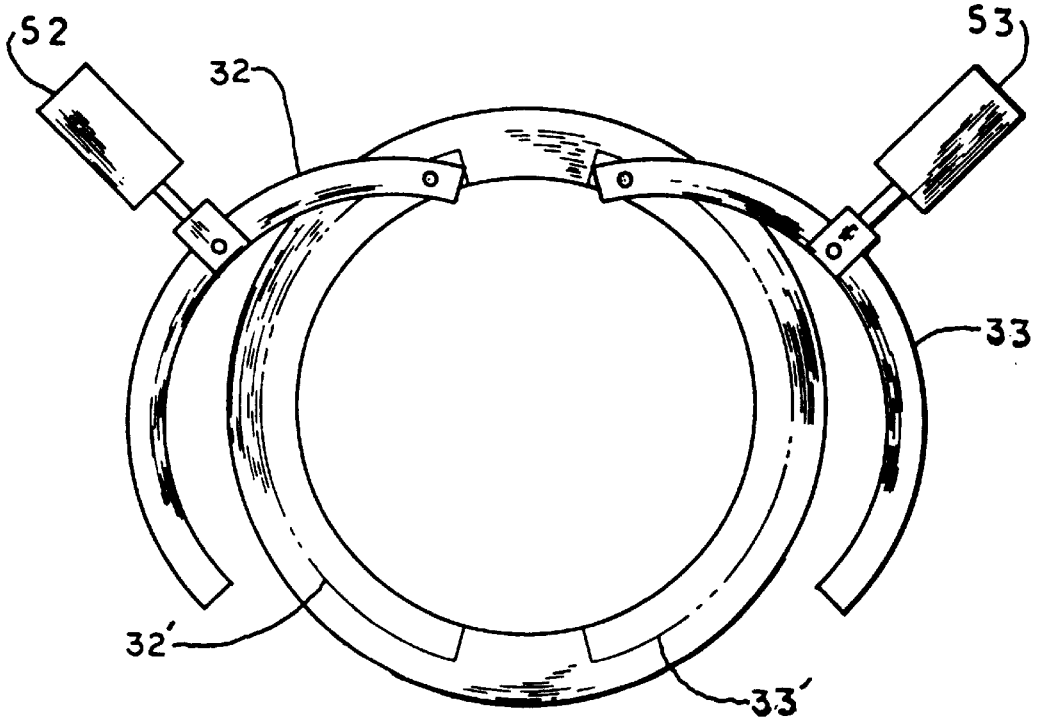
FIG. 5 is an end view of another embodiment including one magnet and hydraulic cylinder to position the magnets on either side of the blind trommel.

As shown in FIGS. 4 and 5, two identical arc shaped magnets 32,33 may be supported at opposite sides of blind trommel 30 extending generally from the bottom to the top thereof. Magnets 32,33 may be provided to lift magnetic material from the bottom of blind trommel 30 and drop it into tray 38 adjacent top 37 of blind trommel 30 depending on whether the rotation of blind trommel 30 is clockwise or counter clockwise.

FIG. 5 shows two arc shaped magnets 32,33 supported adjacent blind trommel 30. Magnets 32,33 have actuating arcuate means 52,53 to move them away from blind trommel 30. Actuating means 52,53 may be hydraulic, pneumatic or other suitable means to move magnets 32,33 from a first position 32,33 to second position 32',33'.

Figure 9:
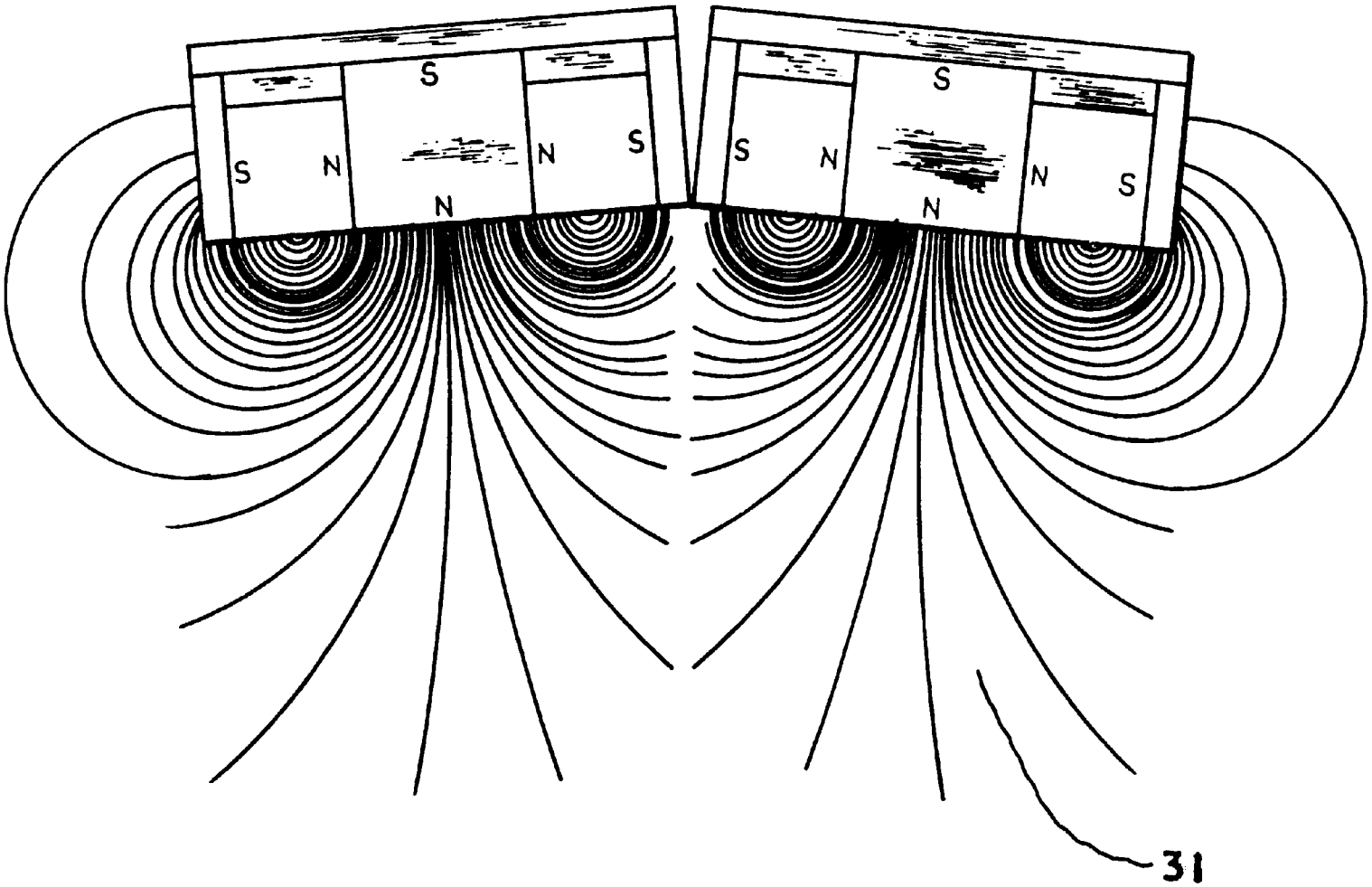
FIG. 9 is a sketch of the magnetic field pattern of the magnet shown in FIGS. 7–8C.

Magnetic member 80 has a flux field pattern shown in FIG. 9. Magnetic member 80 is made up of magnets 84. Each magnet 84 is made up of first magnet 61, second magnet 62 and third magnet 63 between first magnet 61 and second magnet 62. First magnet 61, second magnet 62 and third magnet 63 each have a first North Pole N and a second South Pole S. Magnetic members 61,62,63 may be each made up of plates of ceramic magnetic material. Magnetic members 61,62 each have a first side end adjacent a side of third magnet 63. The field pattern of the magnet member is shown in FIG. 9 with the field forming a toroid shape that extends through the non-magnetic wall of blind trommel 30 and engages the magnetic material including magnetic balls 13 in blind trommel 30 in the bottom part thereof. The magnetic field holds balls 13 and other magnetic material to the inside surface of blind trommel 30 and the magnetic material is carried with the rotation of blind trommel 30 to the upper end 39 of magnet member 32 and out of magnetic field. When the magnetic material and balls are out of the magnetic field they are released and fall into tray 38 from which they are carried to collection area 42 by chute 40.

Arcuate magnet 32 is made up of magnetic members 80. Each of magnetic members 80 have first end 82, second end 83 and back member 81. Each magnet member 80 has first side magnet 61 and second side magnet 62. Third magnet member 63 is disposed between first side magnet 61 and second side magnet member 62. The first end of first side magnet 61 is disposed adjacent third magnet member 63 and the first end of second side magnet 62 is disposed adjacent third magnet member 63.

Figure 6:
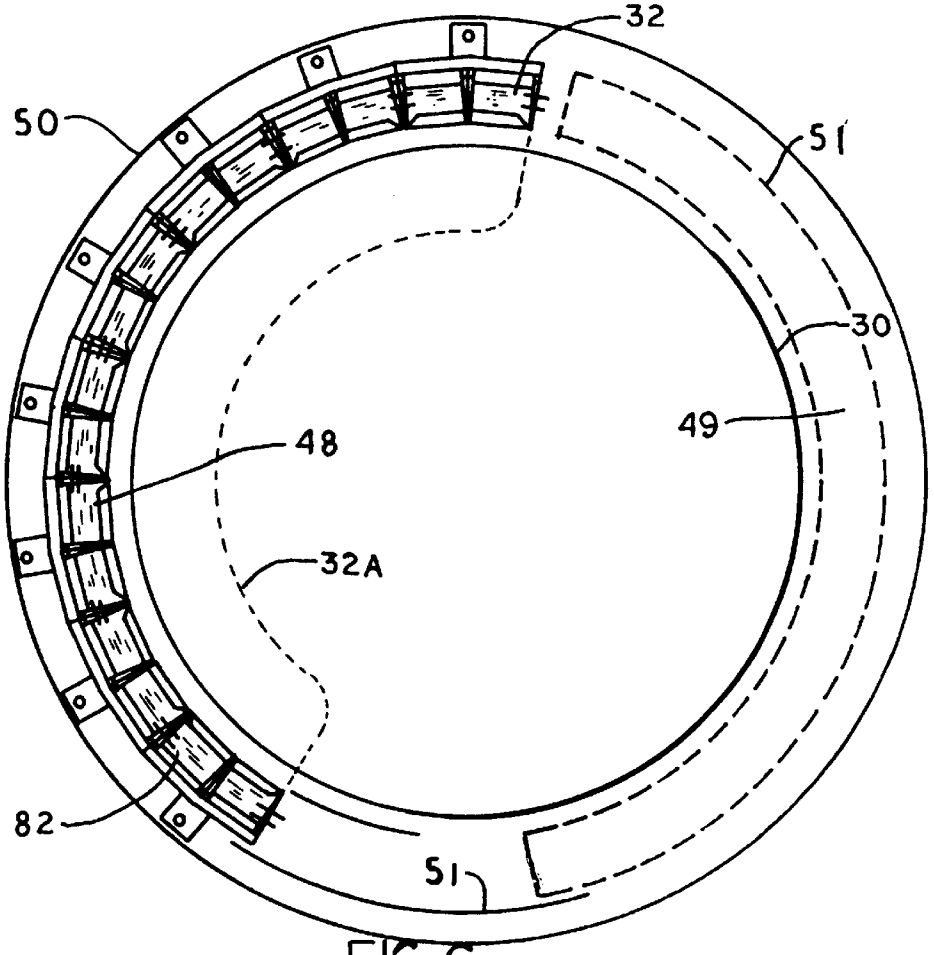
FIG. 6 is an end view of the blind trommel and arc shaped magnet showing the frame supporting the magnet.
Figure 7:
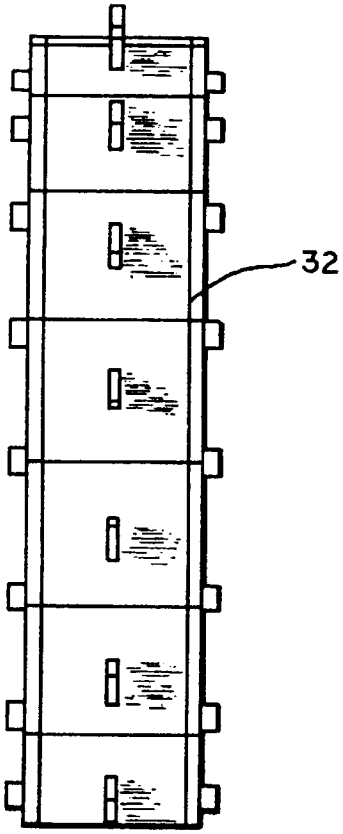
FIG. 7 is a side view of the arc shaped magnet according to the invention showing the frame supporting the magnet.
Figure 8A:
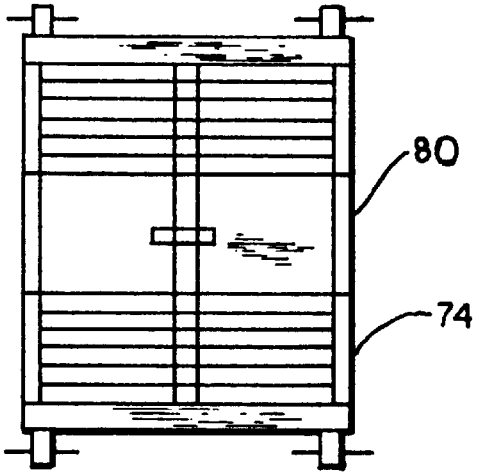
FIG. 8A is a top view of one section of the magnet assembly.
Figure 8B:
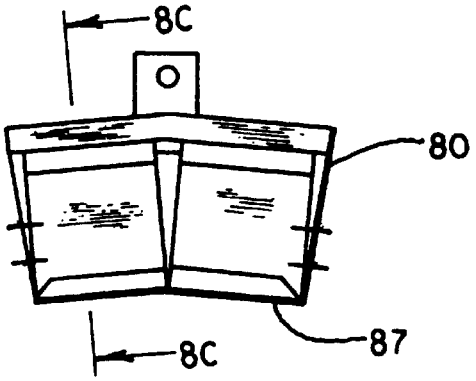
FIG. 8B is an end view of the section shown in FIG. 8A.
Figure 8C:
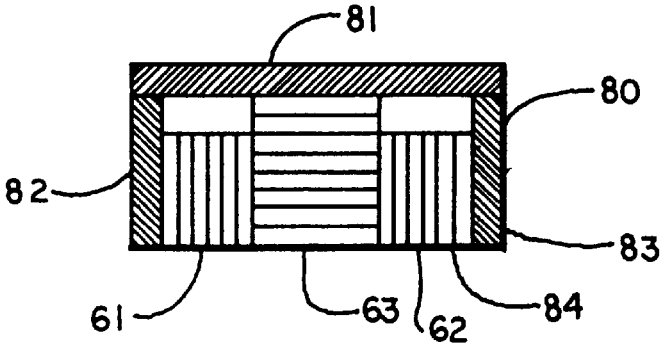
FIG. 8C is a cross sectional view taken on line 8C—8C of FIG. 8B.

FIG. 6 discloses frame 50 which will support magnet 32 in a first position to operate when blind trommel 30 is turning in a clockwise direction. Frame 50 supports magnet 32 on track means 51 which will allow the magnet to be moved to a second dotted line magnet position for use when blind trommel 30 is rotating in a counter clockwise direction. Magnet 32 may also be moved along track means 51 to adjust and optimize the position of magnet 32 within a predetermined range.

FIG. 10 shows a blind trommel section, attached to the outside surface of which is an electromagnet, arranged so that when the electromagnet is energized, ferrous material inside the trommel section will be attracted to the inner surface of the trommel in the vicinity of the electromagnet. As the blind trommel is rotated, the electromagnet is energized from approximately the 6 o'clock magnet position through the 11 o'clock magnet position, at which point it is de-energized, causing the lifted ferrous material to fall into a collection hopper and chute. By attaching the magnet to the trommel surface, at least two advantages are realized as compared to the stationary arc of magnets discussed above: (a) fewer magnets are used since an essentially continuous magnetic field is not required from the 6 o'clock to the 11 o'clock blind trommel positions; and (b) because the magnetic field travels with the blind trommel surface the need for an internal scraper bar to keep the ferrous material moving is minimized or eliminated.

FIGS. 10 shows a cross section of the electromagnet.

FIGS. 11A through 11C show a device similar to FIG. 10 except that multiple electromagnets are used, disposed a round the periphery of the blind trommel at multiple stations and energized and de-energize sequentially as the blind trommel rotates. This structure will increase the ferrous collection capacity of the system.

Figure 12A:
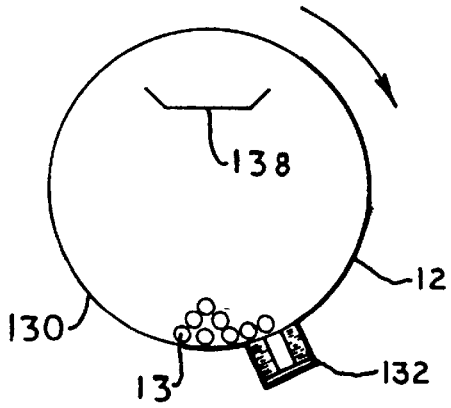
FIG. 12A shows an electromagnet entering the area where ferromagnetic material is separated from the ore flow.
Figure 12B:
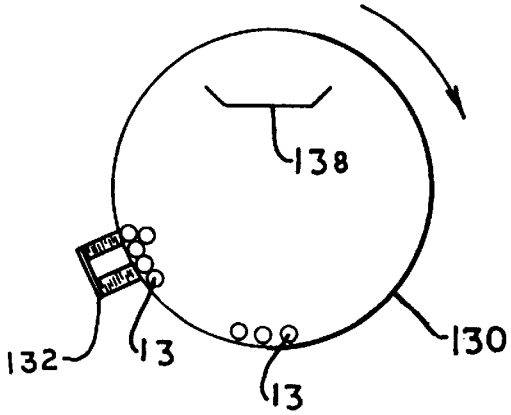
FIG. 12B shows an electromagnet lifting ferromagnetic material to the tray.
Figure 12C:
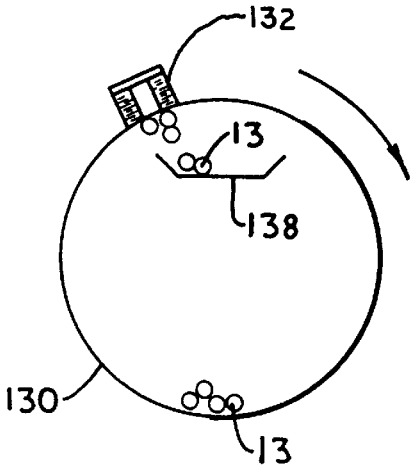
FIG. 12C shows the electromagnet de-energized and ferromagnetic material being deposited in the tray.
Figure 12D:
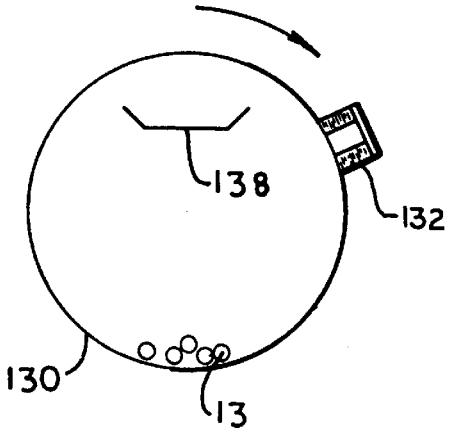
FIG. 12D shows the electromagnet returning to the separation area.

FIGS. 12A–D show the sequence of events during ball pick up. In FIG. 12A electromagnet 132 is approaching balls 113 at the bottom of blind trommel 130 about to pick up balls 113. In FIG. 12B electromagnet 132 has picked up a number of balls 113 and is lifting them up the side of blind trommel 130. At 12C electromagnet 132 is de-energized and balls 113 drop in tray 138. At 12D electromagnet 132 is descending toward the bottom of blind trommel 130 and will be re-energized to pick up more balls 113 as the next rotation of blind trommel 130 commences.

Figure 13A:
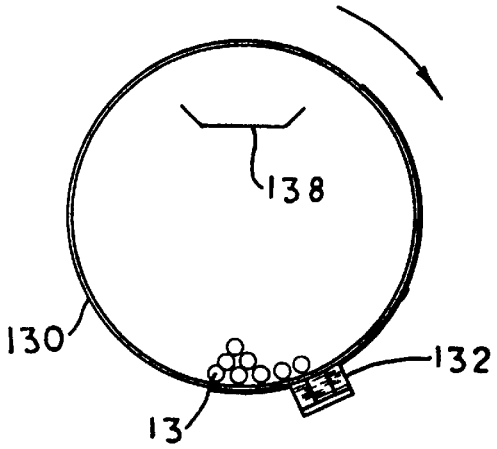
FIG. 13A shows a permanent magnet entering the area where ferromagnetic material is separated from the iron flow.
Figure 13B:
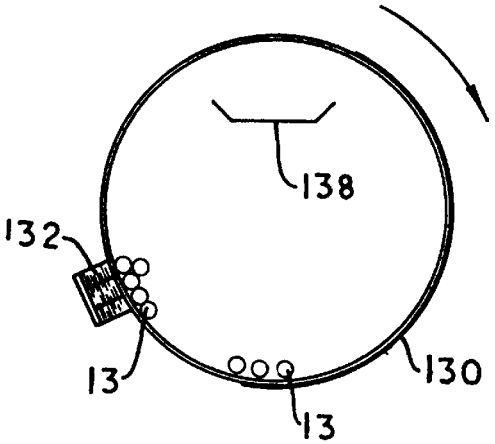
FIG. 13B shows a permanent magnet lifting ferromagnetic material to the tray.
Figure 13C:
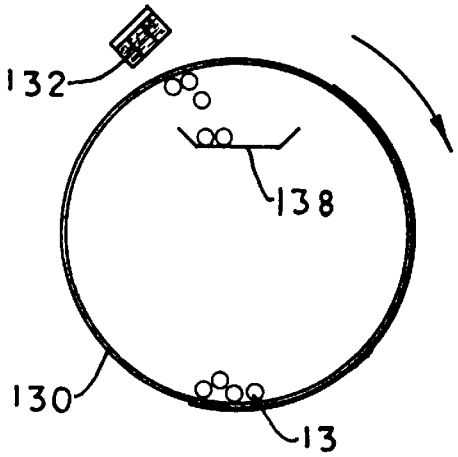
FIG. 13C shows the permanent magnet lifted away from the blind trommel and ferromagnetic material being deposited in the tray.
Figure 13D:
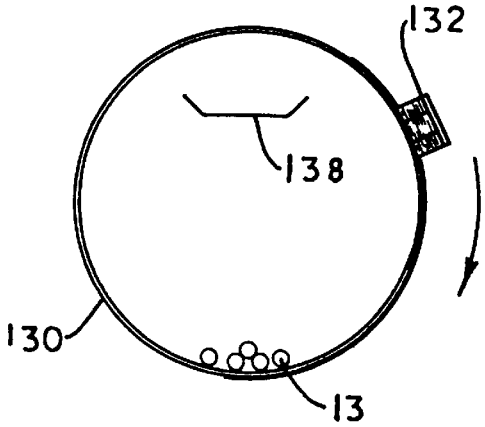
FIG. 13D shows the permanent magnet returning to the separation area.

As shown in FIGS. 13A–D, a device can be used similar to FIG. 12 except that a permanent magnet can be used, arranged so that it can be rotated away from the outer surface of the trommel by a suitable actuator, mechanical linkage, or balance arrangement when the magnet reaches approximately the 11 o'clock position as shown in FIG. 13C. This rotation moves the magnet a sufficient distance from the steel balls so that they will drop into tray 38. The linkage or balance arrangement causes the magnet to remain in the "disengaged" position, at which point it swings back into engagement with the trommel surface. By using a permanent magnet rather than an electromagnet, the initial and operating costs are potentially reduced as compared to the structure of FIG. 12. Otherwise, this system shares the advantages of FIG. 12 with the slight disadvantage of reduced magnet strength (permanent vs. electro).

In another embodiment similar to FIG. 13 with a permanent magnet except that multiple magnets are used, disposed around the periphery of the trommel at multiple stations, as shown in FIGS. 11A, B, and C substituting permanent magnets for the electromagnets. This will increase the ferrous collection capacity of the system as compared to the system illustrated in FIG. 12.

Figure 14:
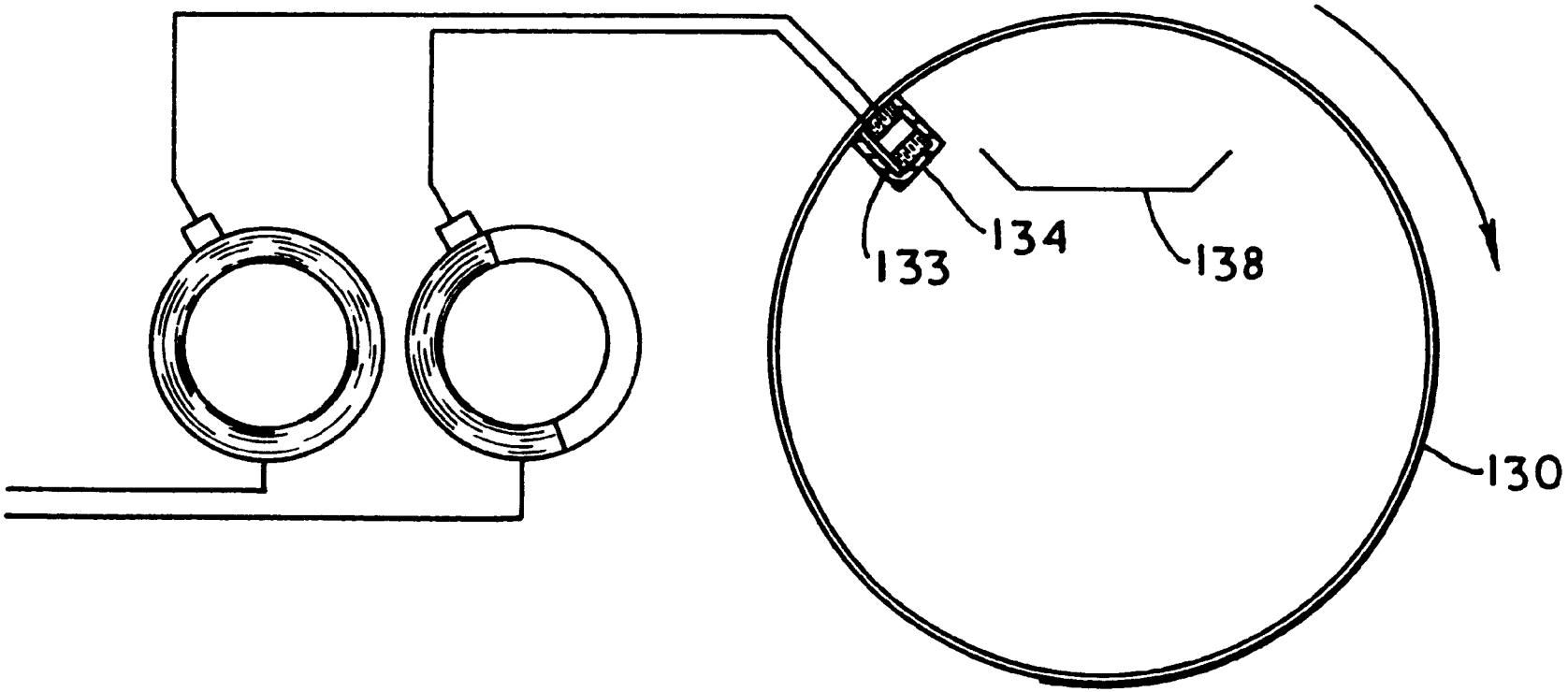
FIG. 14 shows an electromagnet placed inside the blind trommel where it acts as both a lifting magnet and a scraper bar.

In another embodiment as shown in FIG. 14 an electromagnet is attached to the inside surface of the blind trommel. The electromagnet being protected by a suitable housing. An advantage of this arrangement is that the magnet housing itself will serve as a bar or lifter to eliminate any possibility of loss of ferrous material on the rising side of the trommel. Also, by virtue of its location on the inner surface of the trommel, the magnet will attract and hold the ferrous material more efficiently.

A device similar to FIG. 12 except that multiple electromagnets are used, disposed around the inner surface of the trommel. This adds capacity to FIG. 12.

A further advantage of FIG. 12 is that they are easily configurable to adapt to either direction of trommel rotation.

Figure 3:
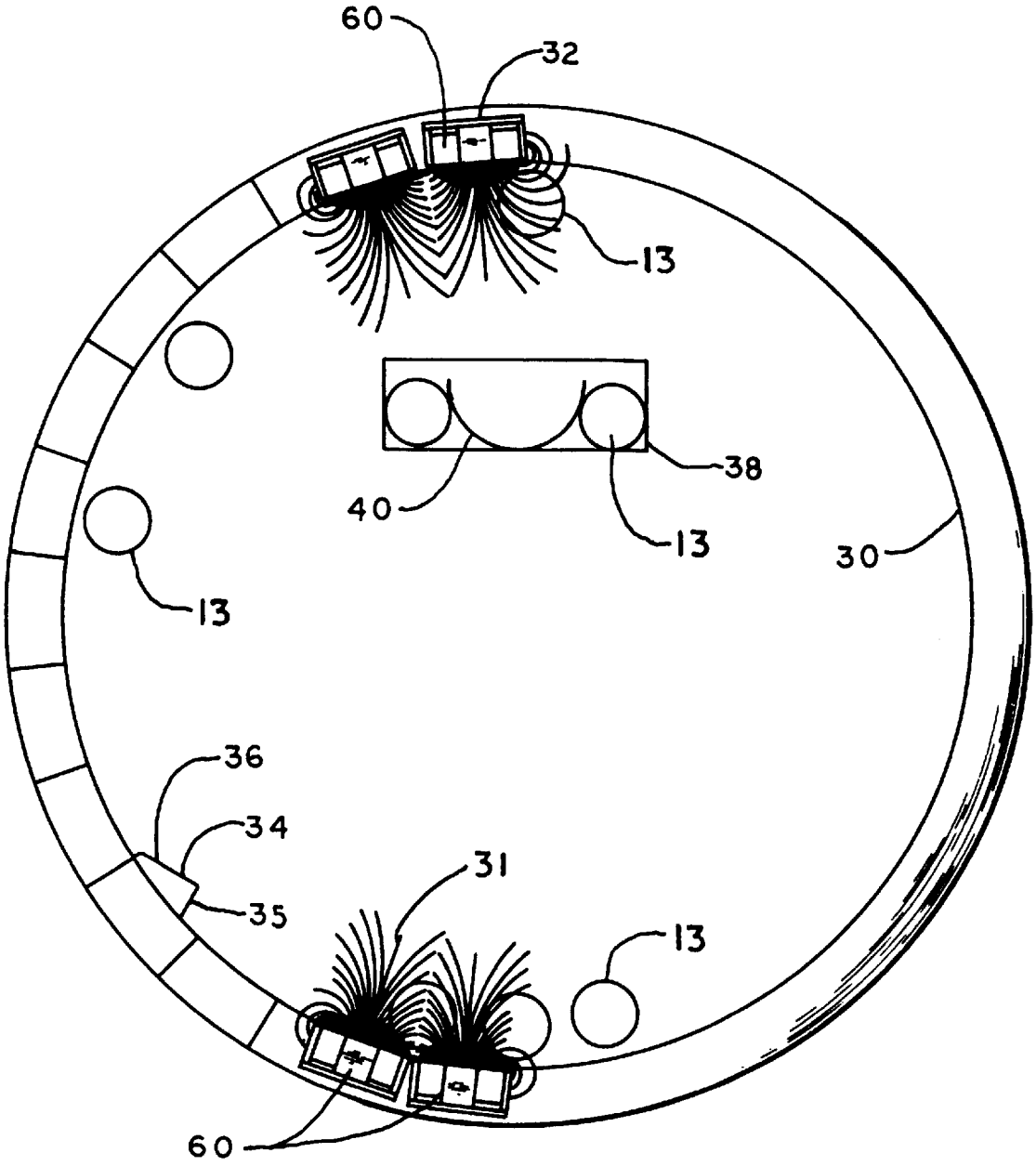
FIG. 3 is an end view of the blind trommel with the arc shaped magnet and the tray according to the invention.

Now referring to the embodiment of the invention shown in FIGS. 12 through 16, blind trommel section 130 is shown similar to blind trommel section 30 shown in FIGS. 1, 2 and 3. Blind trommel section 30 is generally cylindrical in cross sectional shape and has inner periphery and outer periphery. Upper tray 138 is supported under blind trommel and extends from about the 11 o'clock position to about a 1 o'clock position.

Electromagnet 132 is fixed to outer periphery of trommel section 130. When electromagnet 132 is energized, it produces a magnetic field that extends through the non-magnetic trommel body and attracts ferrous material that holds the ferrous material to the inside periphery of trommel 130.

Electrical energy is supplied to electromagnet 132 through springs 140,141 which are of the type familiar to those skilled in the art of electric motor generators. Power lines 142,143 are connected to electrical brushes that contact slip rings 140,141. Slip ring 141 is non-conductive so that no power will be connected to electromagnet 132 when the brush connecting part 143 to the power line is connected.

FIGS. 12A through 12D show the sequence of the operation of electromagnets 132 while blind trommel 130 rotates. Electromagnet 132 is at about the 5 o'clock position. As the trommel rotates, the magnetic field of magnet 132 attracts balls 111 and moves part of them up to the 8 o'clock position shown in FIG. 12B. As the blind trommel continues to rotate to bring magnet 132 to the 11 o'clock position, shown in FIG. 12C, the brush on the slip ring moves on to conducting zone 143 of slip ring 141, thereby de-energizing the electromagnet and dropping steel balls 111 into tray 138. As trommel 130 continues to rotate, electromagnet 132 is brought through the 2 o'clock position shown in FIG. 1D and on down to the position shown in FIG. 12A to attract some more balls 111 and lift them up to tray 138.

FIGS. 11A through 11C show multiple electromagnets 132 on trommel 130 used to lift balls 111 and take them to tray 138. A suitable commentator with a separate slip ring for each of electromagnets 132 will be required.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

What is claimed is:

1. An arc shaped magnet for lifting and separating steel balls from a mixture of ferromagnetic and non-ferromagnetic material comprising:

an arc shaped magnet having a first end and a second end;

an intermediate part between said first end and said second end;

a non-magnetic work support member supported adjacent said arc shaped member;

a magnetic field means from said arc shaped magnet member extending through said non-magnetic work support member;

means to move said work support member in close proximity to said arc shaped magnet whereby magnetic material on said work support member is attracted to said work support member by said magnetic field and said magnetic material is moved with said work support member to said second end part of said magnet and out of the magnetic field from said arc shaped magnet by allowing said magnet material to drop into a tray below said end of said magnet;

providing pivot means supporting said arc shaped magnet adjacent said blind trommel in a predetermined first position for rotation in a first direction;

said pivot means rotating said magnet to a predetermined second position for rotation in a second direction.

2. The magnet recited in claim 1 wherein a central discharge chute is connected to said tray and said magnetic material from said magnet is conveyed from said tray through said chute to a collection area.

3. The magnet recited in claim 1 wherein said work support member comprises a generally cylindrical section.

4. The arc shaped magnet recited in claim 1 further comprising magnet members;

each said magnet member comprising a first magnet, a second magnet and a third magnet between said first magnet and said second magnet;

each said magnet having a first side, a second side, a first end and a second end;

a first magnetic pole on one said end of said first magnet;

a second magnetic pole on the other end of each said magnet;

a first pole on said first magnet and a second pole on said second magnet being disposed adjacent said side of said third magnet whereby a magnetic field path is provided from said first end of said first magnet to said side of said third magnet to said first side of said first magnet and to said second side of said first magnet by providing a radial shaped flux field pattern.

5. The magnet recited in claim 4 wherein said plurality of said magnet members are disposed in end to end relation with each other forming an arcuate shaped magnet member.

6. A separator comprising a blind trommel attached to a trommel to remove ferromagnetic materials from a mixture of ferromagnetic and non-ferromagnetic materials as said trommel is rotated;

an arc shaped magnet positioned adjacent and around the outer surface of said blind trommel and extending substantially from a point adjacent the bottom of said blind trommel to a point adjacent the top of said blind trommel;

a tray supported inside said blind trommel below the top thereof in a position t receive said ferromagnetic materials as they pass the end of said arc shaped magnet;

providing pivot means supporting said arc shaped magnet adjacent said blind trammel in a predetermined first position for rotation in a first direction;

said pivot means rotating said magnet to a predetermined second position for rotation in a second direction.

7. The separator recited in claim 6 further comprising a lifter attached to and extending across the inner surface of said blind trommel and extending upwardly therefrom.

8. The separator recited in claim 6 further comprising a chute extending from said tray to a predetermined collection point.

9. The separator recited in claim 6 further comprising a second arc shaped magnet supported adjacent said blind trommel in the opposite side of said blind trommel the first magnet;

the second magnet to capture and lift ferromagnetic material when the direction of rotation of said blind trommel is reversed.

10. The separator recited in claim 6 further comprising a framework means extending generally around said blind trommel and supporting said magnet adjacent said blind trommel in a predetermined first position for rotation in a first direction, in a predetermined second position for rotation in a second direction.

11. The separator recited in claim 6 further comprising adjusting means to support and optimize the position of said magnet within a predetermined range.

12. The separator recited in claim 6 further comprising adjusting means to support and optimize the position of said magnet within a predetermined range.

13. The separator recited in claim 6 wherein said arc shaped magnet comprises permanent magnets.

14. The separator recited in claim 6 wherein said arc shaped magnet comprises electromagnets.

15. The separator recited in claim 6 further comprising track means extending generally around said blind trommel and supporting said magnet adjacent said blind trommel in a predetermined first position for rotation in a first direction, in a predetermined second position for rotation in a second direction.

16. The separator recited in claim 15 further comprising adjusting means to support and optimize the position of said magnet, said magnet within a predetermined range.

17. A separator comprising a cylinder to remove ferromagnetic materials from a mixture of ferromagnetic and non-ferromagnetic materials as said cylinder is rotated;

an electromagnet attached to the outer surface of said cylinder;

said electromagnet being energized when said magnet position is near the bottom of said cylinder to attract and hold ferrous material to the inside of said cylinder as said cylinder rotates;

said electromagnet being de-energized when said magnet position is near the top of said cylinder;

a tray is provided to collect said ferrous material when it is released;

providing pivot means supporting said electro magnet adjacent said cylinder in a predetermined first position for rotation in a first direction;

said pivot means rotating said electro magnet to a predetermined second position for rotation in a second direction.

18. The separator recited in claim 17 further comprising more than one electromagnet;

said electromagnets being spaced from one another around the periphery of said cylinder.

19. The separator recited in claim 17 wherein multiple electromagnets are spaced from one another around the periphery of the outside surface of said cylinder.

20. A separator comprising a cylinder to remove ferromagnetic materials from a mixture of ferromagnetic and non-ferromagnetic material as said cylinder is rotated;

a permanent magnet attached to the outer surface of said cylinder and movable from a first position against said cylinder to a second position removed from said cylinder;

said permanent magnet being at said first position when said magnet position is near the bottom of said cylinder to attract and hold ferrous material to the inside of said cylinder as said cylinder rotates;

said permanent magnet being moved to said second position when said magnet position is near the top of said cylinder;

a tray is provided to collect said ferrous material when it is released;

said permanent magnet being returned to said first position before said magnet position reaches the bottom of said cylinder;

providing pivot means supporting said arc shaped magnet adjacent said blind trommel in said first position;

said pivot means moving said magnet to said second position.

21. The separator recited in claim 20 further comprising more than one permanent magnet;

said permanent magnets being spaced from one another around the periphery of said cylinder.

* * * * *